US005145229A

United States Patent [19]

Metzger

[11] Patent Number: 5,145,229

[45] Date of Patent: Sep. 8, 1992

[54] BOWLING BALL HOLDER

[76] Inventor: Romain Metzger, 15559 Brookridge Blvd., Brooksville, Fla. 34613

[21] Appl. No.: 774,096

[22] Filed: Oct. 15, 1991

[51] Int. Cl.[5] ..... A63B 69/00

[52] U.S. Cl. ..... 294/158; 294/15; 273/54 B

[58] Field of Search ..... 294/15, 89, 137, 158, 294/170; 273/54 R, 54 B, 63 R, 63 A, 63 F, 64, DIG. 30; 206/315.9, 315.91

[56] References Cited

U.S. PATENT DOCUMENTS

| | | | |
|---|---|---|---|
| 977,776 | 12/1910 | Boland | 273/64 |
| 1,506,778 | 9/1924 | Senn | 273/64 |
| 2,108,236 | 2/1938 | Scott | 273/54 B X |
| 3,091,681 | 5/1963 | Mayer | 206/315.91 X |
| 3,214,167 | 10/1965 | Pell | 273/54 B |
| 3,880,426 | 4/1975 | Morse | 273/54 B |
| 4,332,383 | 6/1982 | Milden et al. | 273/64 |
| 4,938,487 | 7/1990 | Ponsart | 273/54 B |

*Primary Examiner*—Margaret A. Focarino
*Assistant Examiner*—Dean J. Kramer
*Attorney, Agent, or Firm*—Richard W. Carpenter

[57] ABSTRACT

A device for lifting, holding carrying, or swinging a bowling ball to practice the arm movement required for bowling. The device includes a pair of cylindrical bodies adapted to be inserted in adjacent finger holes of a bowling ball and which are detachably interconnected by a pair of separate straps that are detachably connectable to each other and which can be drawin tightly to keep the bodies in the holes and thereby form a handle.

4 Claims, 1 Drawing Sheet

BOWLING BALL HOLDER

BACKGROUND OF THE INVENTION

1. Field of the Invention

This invention relates to bowling ball holders, and more particularly to a device adapted to be readily attached to or removed from the finger holes of a bowling ball, so that it can be used to lift, hold, carry, or swing a ball to practice a bowler's method of delivery.

b. 2. Description of Background Art

A background art search directed to the subject matter of this invention conducted in the United States Patent and Trademark Office disclosed the following United States Letters Patent:

| | | |
|---|---|---|
| Des. 191,604 | Des. 277,903 | 1,024,635 |
| 3,011,648 | 3,690,360 | |

None of the patents found in the search discloses a bowling ball holder comprising a pair of separate finger-like members adapted to be inserted in separate finger holes of a ball and which may be readily attached to each other or removed from each other by flexible straps with adjustable fastening means to form a handle-like structure.

SUMMARY OF THE INVENTION

It is an object of this invention to provide an improved device adapted to be readily attached to or removed from the finger holes of a bowling ball and that can be used to lift, hold, carry, or swing a ball to practice a method of delivery.

Another object of the invention is to provide a device of the type described that is of relatively simple design and construction, that is inexpensive to produce, and that is small enough to be easily carried in one's pocket or purse.

A more specific object of he invention is the provision of a bowling ball holder ball holder comprising a pair of separate finger-like members adapted to be inserted in separate finger holes of a ball and which may be readily attached to each other, or removed from each other, by flexible straps with adjustable fastening means to form a handle-like structure.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 6:
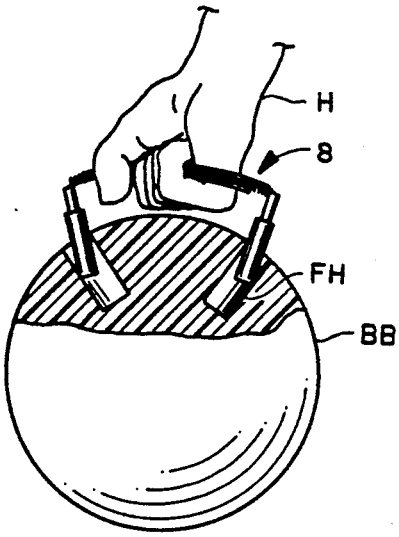
FIG. 6 is a view similar to FIG. 4, but illustrating the manner in which the holder is used to lift and/or carry a ball.

Referring now to the drawings for a better understanding of the invention, in FIG. 6 a holder embodying features of the invention and indicated generally at 8, is shown positioned in finger holder FH of a bowling ball BB and being held by a hand H of a bowler.

Figure 1:
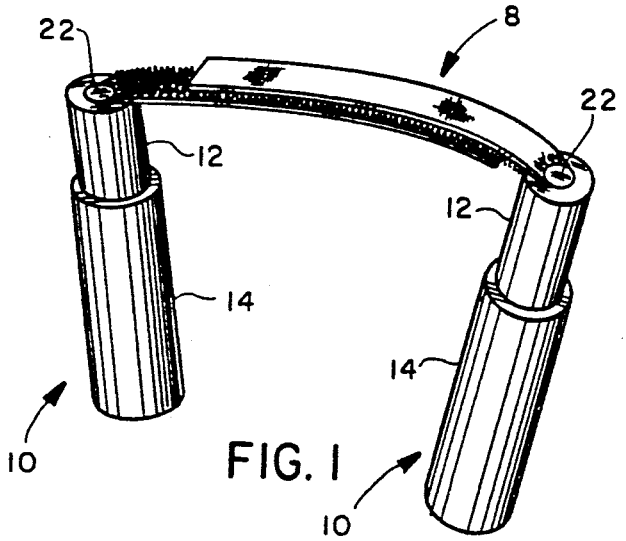
FIG. 1 is a fragmentary perspective view of a bowling ball holder embodying features of the present invention, shown in assembled condition, but not attached to a bowling ball.
Figure 4:
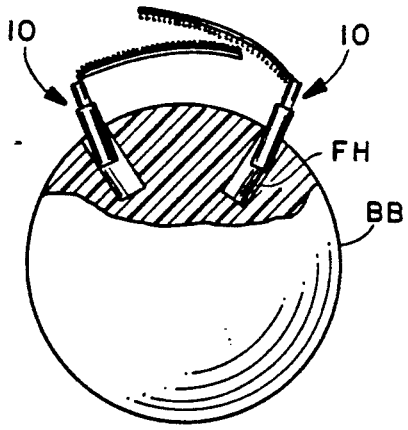
FIG. 4 is a fragmentary perspective view, partly in vertical section, of a bowling ball with the two components of the holder shown positioned in the finger holes of the ball, but not attached to each other.

As best seen in FIG. 1, the holder 8 comprises a pair of finger-like finger hole engaging members 10. Each member 10 includes a body with a cylindrical stem or post 12 formed of a relatively rigid material.

In order to prevent any damage to a ball at the edges of the finger holes, at least the lower end portion of each post 12 may be enclosed in a hollow cylindrical sleeve 14 formed of a relatively resilient material.

Figure 2:
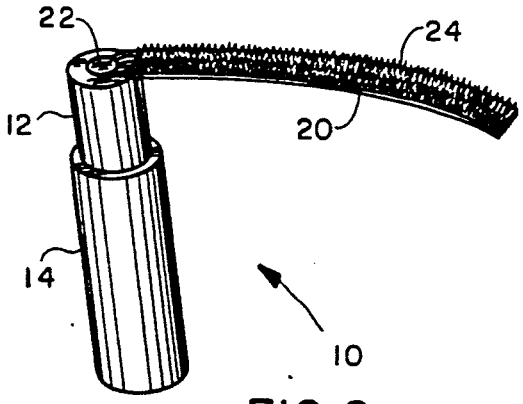
FIGS. 2 and 3 are views similar to FIG. 1, but illustrating the separate components of the holder.
Figure 5:
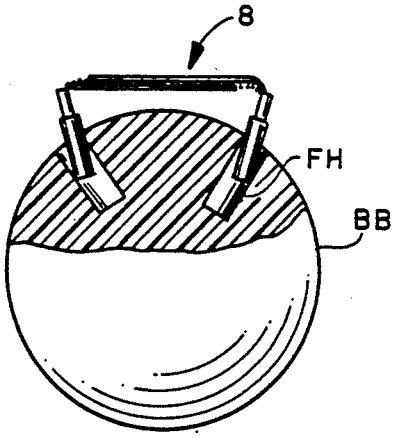
FIG. 5 is a view similar to FIG. 3, but with the components of the holder shown attached to each other.
Figure 3:
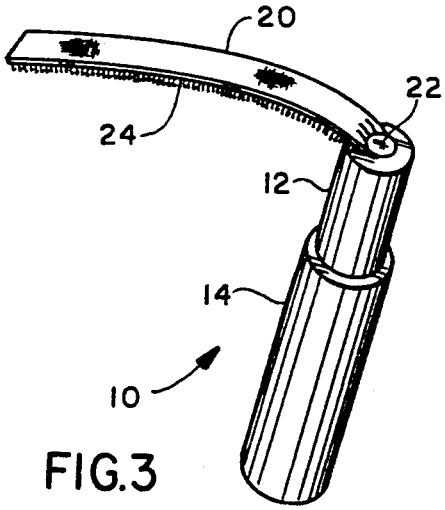

As best seen in FIGS. 2 and 3, a connecting strap 20 is attached at one end to the upper end of each post 12 by a pin 22. However, if desired, the strap ends may be secured to the posts 12 by an adhesive (not shown) or by any other practical retaining means.

In order to facilitate the rapid adjustable attachment of the connecting straps to each other they preferably each include a touch and close type fastening tape 24, such as the loop and hook material sold under the trademark "VELCRO".

If desired, however, other types of fastening means may be used. One such fastening means (not shown) is a reusable, pressure sensitive, adhesive tape. Also, a buckle (not shown) may be used, although a buckle would not be quite as convenient as the fastening tape arrangement.

In order to use the holder of the invention, the bodies of the separate members 10 are placed in the finger holes FH of the ball BB, and the straps 20 are pulled tightly toward each other and secured to each to each other, as illustrated in FIG. 1.

This forms a one-piece, handle-like, holder structure that can be used to lift, hold, carry, and/or swing a ball to practice and perfect the arm swing of a bowler without the bowler having to insert his or her fingers in the ball.

What is claimed is:

1. A device for lifting, holding, carrying, and swinging a bowling ball to practice the movement required for bowling, said device being arranged and disposed for rapid attachment to and removal from a conventional bowling ball, having a pair of laterally spaced finger holes, and comprising:

(a) a pair of similar finger hole engaging members adapted for detachable, adjustable interconnection to form a handle-like structure;

(b) each of said members including:

(i) a body having a generally cylindrical solid post, formed of a relatively rigid material, and a generally cylindrical hollow sleeve, formed of a relatively soft material, enclosing a lower end portion of said post;

(ii) a connecting strap having one end secured to an upper end portion of said post and having another end presenting adjustable touch and close type fastening means;

(c) said member bodies having outer diameters less that the inner diameters of said bowling ball finger holes and being adapted for insertion therein, with their respective connecting straps drawn tightly together and detachably secured to each other to maintain said bodies in said finger holes and thereby form said handle-like structure for holding said bowling ball.

2. A bowling ball holder according to claim 1, wherein said touch and close fastening means includes hook and loop type fastening tape.

3. A device for lifting, holding, carrying, and swinging a bowling ball to practice the movement required for bowling, said device being arranged and disposed for rapid attachment to and removal from a conventional bowling ball, having a pair of laterally spaced finger holes, and comprising:

(a) a pair of similar finger hole engaging members adapted for detachable, adjustable interconnecting to form a handle-like structure;

(b) each of said members including:

(i) a body having an elongated, generally cylindrical post, formed of a relatively rigid material and having one end covered with a relatively soft material;

(ii) a connecting strap having one end secured to an upper end portion of said post and having another end presenting adjustable fastening means;

(c) said member bodies having outer diameters less than the inner diameters of said bowling ball finger holes and being adapted for insertion therein, with their respective connecting straps drawn tightly together in parallel, overlapping relationship and detachably secured directly to each other to urge said members toward each other and maintain said bodies in said finger holes and thereby form said handle-like structure for holding said bowling ball.

4. A bowling ball holder according to claim 3, wherein said adjustable fastening means includes hook and loop type fastening tape.

* * * * *